US006698752B1

(12) United States Patent
Kakuta et al.

(10) Patent No.: US 6,698,752 B1
(45) Date of Patent: Mar. 2, 2004

(54) SHEET TRANSPORT DEVICE

(75) Inventors: Masayuki Kakuta, Suita (JP); Masaki Degichi, Kashiba (JP); Kuniaki Araishi, Osaka (JP); Kazuyoshi Osawa, Osaka (JP); Yutaka Aso, Hirakata (JP); Hideki Kitagawa, Kadoma (JP)

(73) Assignee: Kyocera MITA Corporation, Osaka-fu (JP)

( * ) Notice: Subject to any disclaimer, the term of this patent is extended or adjusted under 35 U.S.C. 154(b) by 0 days.

(21) Appl. No.: 09/524,735

(22) Filed: Mar. 13, 2000

(30) Foreign Application Priority Data

Mar. 15, 1999 (JP) ..... 11-068876
Mar. 16, 1999 (JP) ..... 11-070768
Mar. 16, 1999 (JP) ..... 11-070769

(51) Int. Cl.[7] ..... B65H 29/70
(52) U.S. Cl. ..... 271/188; 271/209
(58) Field of Search ..... 271/186, 188, 271/209, 225, 902, 184

(56) References Cited

U.S. PATENT DOCUMENTS 4,350,332 A * 9/1982 Knight ..... 271/188
5,194,904 A * 3/1993 Ruch
5,312,108 A * 5/1994 Hayashi ..... 271/188
5,887,868 A * 3/1999 Lambert et al. ..... 271/186
6,098,977 A * 8/2000 Sato et al. ..... 271/186
6,209,861 B1 * 4/2001 Kakuta et al.

FOREIGN PATENT DOCUMENTS

| | | |
|---|---|---|
| JP | 63-161263 | 10/1988 |
| JP | 2-008245 | 1/1990 |
| JP | 3-067852 | 3/1991 |
| JP | 7-206275 | 8/1995 |
| JP | 8-067392 | 3/1996 |
| JP | 8-225218 | 9/1996 |
| JP | 8-324863 | 12/1996 |

* cited by examiner

*Primary Examiner*—David H. Bollinger
(74) *Attorney, Agent, or Firm*—Jordan and Hamburg LLP

(57) ABSTRACT

A projecting tab formed with a bulged portion and an indent on an upper side thereof is provided inwardly projecting in a transport path. A sheet being transported in the transport path is formed into a seemingly wavy configuration in the width direction of the transport path while in contact with the projecting tab. The sheet thus formed with the seemingly wavy configuration is given with a sufficient transport backup force in a transport direction, thereby being hard to bend in the transport direction. Thus, the sheet supplied with the sufficient transport backup force is free from a curled lead end, folded or bent corner lead end of the sheet in the transport direction, and sheet jam. The arrangement of the projecting tab securely accomplishes sheet transport in a desired transport direction without a possibility of sheet transport failure.

19 Claims, 17 Drawing Sheets

SHEET TRANSPORT DEVICE

This application is based on patent application Nos. 11-68876, 11-70768 and 11-70769 filed in Japan, the contents of which are hereby incorporated by references.

BACKGROUND OF THE INVENTION

This invention relates to a sheet transport device for transporting sheets such as documents and copy paper (hereinafter, also simply referred to as "sheet") for use in a copier, printer, facsimile machine, scanner and so forth.

Heretofore, a sheet transport device for transporting sheets for use in, for example, a copier, has been provided with a transport path constituting a pair of transport planes disposed opposing to each other. Sheets are successively transported along the transport path in a specified order.

In the above conventional sheet transport device, a smooth sheet transport may be obstructed and a desirable transport state may not be accomplished depending on the configuration of the transport path. For instance, in the case where the transport path has a curved portion or a narrowed region, it is highly likely that the sheet being transported is stuck at the portion, thereby resulting in a folded lead end of the sheet or that the sheet is forcibly transported in a frictional state with the transport plane, thereby generating a smear on the sheet in the case where the sheet is copy paper for image formation. In a worst case, a sheet jam may occur in the transport path.

SUMMARY OF THE INVENTION

It is an object of the present invention to provide a sheet transport device that enables to securely accomplish a desired sheet transport state while preventing a drawback such as generation of a folded or bent lead end of a sheet and a sheet jam by applying a transport backup force to the sheet in a sheet transport direction along a sheet transport path.

In order to fulfil the above objects, in accordance with the present invention, a sheet transport device for transporting a sheet along a transport path comprises a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
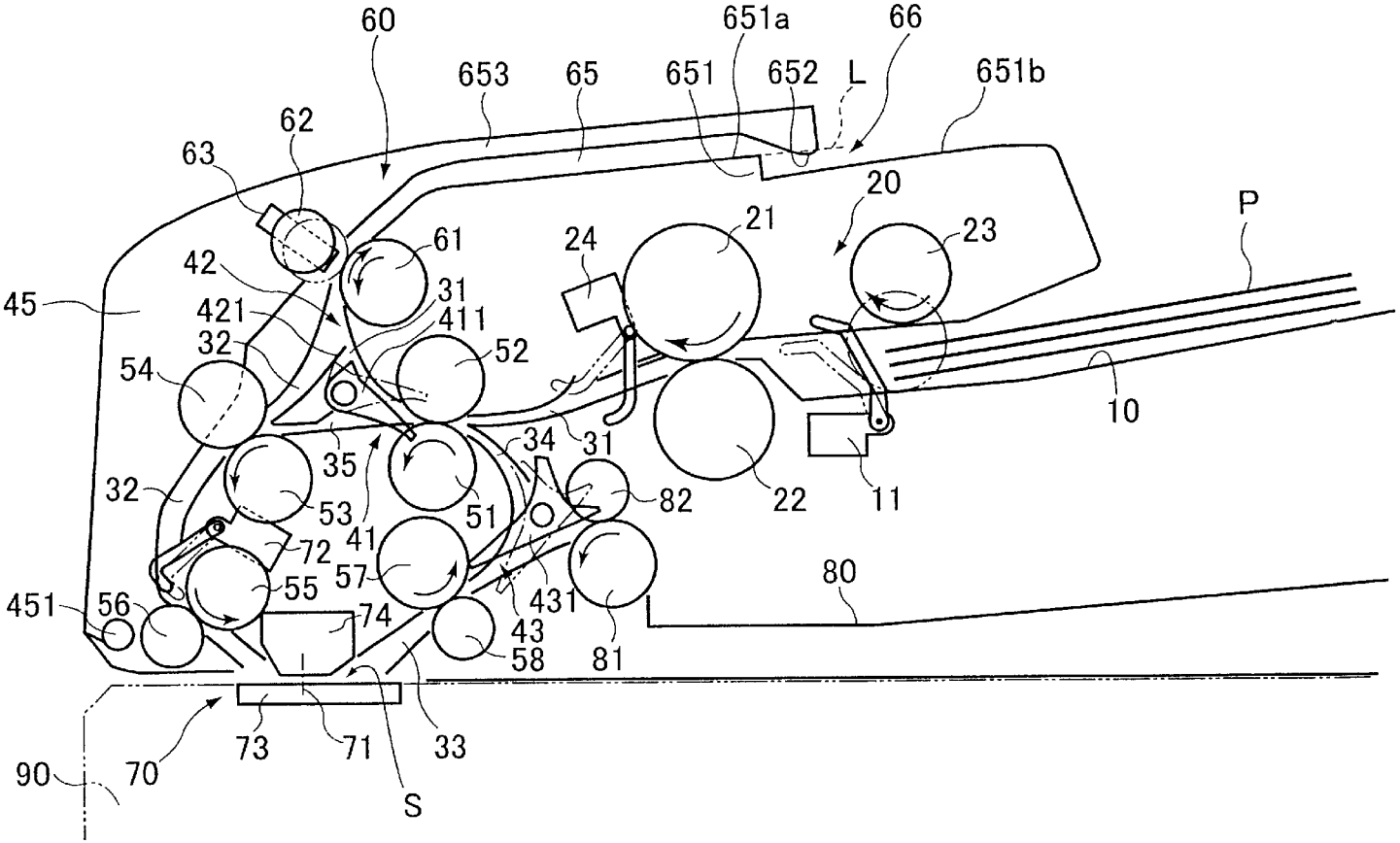
FIG. 1 is a schematic diagram showing an entire configuration of a sheet transport device incorporated in a document image reader as an embodiment according to this invention.

FIG. 1 is a diagram showing an embodiment of a sheet transport device according to this invention, specifically a sheet transport device incorporated in a document image reader loaded on a top part of a copier. Hereinafter, an overall construction of the document image reader is described prior to a detailed description of the sheet transport device.

Document Image Reader

The document image reader is constructed such that a set of documents (sheet set) stacked on a document tray 10 in the order of pages in a manner that a first page thereof facing upward lies on the uppermost position of the document set are fed one by one to read an image data of each page and discharged and stacked onto a discharge tray 80 in the order of pages in a manner that the first page facing downward lies at the lowermost position of the document set. The document image reader selectively carries out a single-sided image reading when a set of documents has image data on one side thereof, and carries out a double-sided image reading when a set of documents has image data on both sides thereof. Also, the document image reader discharges the document set in the same order as having read the image data thereof.

Although this embodiment describes an example that the sheet transport device according to this invention is incorporated in the document image reader loaded on the top part of a copier, the sheet transport device having a similar configuration as in this embodiment may be incorporated in a scanner or a facsimile machine. Also, the sheet transport device according to this invention may be applied as a sheet transporter for transporting copy paper in an image forming apparatus such as a copier, printer and facsimile machine.

Referring back to the configuration of the document image reader in this embodiment, the document tray 10 is a document (sheet) setting section so constructed as to enable to stack a set of documents having image data. A document sensor 11 is provided below the document tray 10 to detect whether the document set is placed on the document tray 10.

A separating/feeding section 20 is adapted to separate the document set stacked on the document tray 10 one by one to feed the uppermost document P to a first transport path 31. The separating/feeding section 20 includes a forward roller 23 disposed above the document tray 10 to feed the document P toward a clearance between a feed roller 21 and a separation roller 22. While the feed roller 21 drivingly rotates to forward the document P from the document tray 10, the separation roller 22 in slide contact with the feed roller 21 is driven in frictional contact with the feed roller 21. Thereby, the document set stacked on the document tray 10 are separated one by one and the uppermost document P is fed to the first transport path 31. Numeral 24 is a feed sensor for detecting a lead end or tail end of the document P guided to the first transport path 31.

The first transport path 31 is a transport path extending from the separating/feeding section 20 to a document inverting section 60. A pair of registration rollers 51, 52 are disposed at a certain position on the first transport path 31 to feed the lead end of the document P forward as timed with an image reading. The first transport path 31 is connected to a fifth transport path 35 at downstream of the registration roller 51 with respect to a document transport direction via a first junction 41. An inverting switch lever 411 disposed at the first junction 41 is operated to selectively change the transport route for the document P guided to the first junction 41 between downstream side of the registration roller 51 on the first transport path 31 with respect to the document transport direction and the fifth transport path 35. Note that the fifth transport path 35 is a transport path used in single-sided image reading.

The first to fifth transport paths 31 to 35 constitute a main transport path.

The document inverting section 60 is adapted to guide the document P fed on the first transport path 31 to a second transport path 32 by inverting the document transport direction by a switchback operation, thereby turning the side of the document P. Specifically, the document inverting section includes an inverting roller 61 rotatable in forward and backward directions and a driven roller 62 in slide contact with the inverting roller 61. The document P nipped between the inverting roller pair 61, 62 is transportable in opposite directions in response to rotation of the inverting roller 61 in forward and backward directions, thereby accomplishing a switchback operation of the document P being guided in and out of the document inverting section 60.

The driven roller 62 is movable toward and away from the inverting roller 61 by a roller driver means 63. When the driven roller 62 is away from the inverting roller 61, the document P carried in between the inverting roller pair 61, 62 is allowed to be freely movable without causing a frictional force with the inverting roller pair 61, 62. Thus, the document inverting section 60 is rendered into a state where a next document of the document set is allowed to enter the document inverting section 60 while letting the preceding document to exit from the document inverting section 60.

More specifically, a switchback route 65 extends from a certain position between the inverting roller pair 61, 62 in such a direction as to cover part of the document tray 10 to temporarily hold the document P on the way of switchback operation. The switchback route 65 is formed with an opening at a position above the separating/feeding section 20. The opening is opened toward an exterior of a main body of the sheet transport device. When a document having the longer side thereof with respect to the transport direction is subjected to a switchback operation in the switchback route 65, the lead end of the document in the entering direction of the document inverting section 60 is temporarily exposed outside of the device main body.

The first transport path 31 is connected to the second transport path 32 via a second junction 42 at a position below the inverting roller pair 61, 62. A projecting tab 421 extending from a lower side wall constituting the second transport path 32 is provided in the second junction 42. The projecting tab 421 is so projected as to narrow the exit of the first transport path 31. The projecting tab 421 is adapted to securely transport the document carried into the first transport path 31 to the document inverting section 60 and to securely guide the document exiting from the document inverting section 60 to the second transport path 32.

The second transport path 32 is a transport path extending from the document inverting section 60 to an image reading section 70. A pair of upper transport rollers 53, 54 and a pair of lower transport rollers 55, 56 are provided at respective positions on the second transport path 32 to transport the document P carried into the second transport path 32 to an image reading position 71 of the image reading section 70. Note that the aforementioned fifth transport path 35 used for single-sided image reading is jointed to the second transport path 32 at upstream side of the upper roller pair 53, 54 with respect to the document transport direction.

A timing sensor 72 is provided at an upstream position of the lower roller 55 with respect to the document transport direction. The timing sensor 72 is adapted to detect the lead end and the tail end of the document P in the transport direction so as to supply a timing signal indicating a document image reading by the image reading section 70.

The image reading section 70 is so constructed that clearance S defined by a contact glass 73 provided on a top part of a main body 90 of the copier and a document guide (or sheet guide) 74 disposed above the contact glass 73 constitutes an image reading region including the image reading position 71. Image data on the side of the document P facing downward is read while being transported over the image reading position 71.

The image reading section 70 is internally provided with an exposure lamp for irradiating light onto the document surface, an assembly of lenses and reflective mirrors for guiding reflected light from the document surface in a specified direction, an image reading mechanism for detecting image data based on the reflected light, etc.

A third transport path 33 is a transport path extending from the image reading section 70 to the discharge tray 80. A pair of intermediate rollers 57, 58 is disposed at a certain position on the third transport path 33 to transport the document P further downstream with respect to the document transport direction. The third transport path 33 is connected to a fourth transport path 34 via a third junction 43 on downstream side of the intermediate roller pair 57, 58 with respect to the document transport direction. A discharging switch lever 431 is provided in the third junction 43 to selectively change the transport route for the document P between the third transport path 33 downstream of the third junction 43 with respect to the document transport direction and the fourth transport path 34.

Note that the fourth transport path 34 is adapted to transport the document P toward upstream of the registration roller pair 51, 52 on the first transport path 31 after one side image reading so as to execute the opposite side image reading when double-sided image reading is designated. Upon completion of the opposite side image reading, the document P, after passing the fourth transport path 34, is transported to the third transport path 33 again after turning the side thereof in the document inverting section 60.

The discharge tray 80 is a document (sheet) discharge section for discharging the document P after an image reading. The discharge tray 80 is disposed below away from the document tray 10 and the document after single-sided image reading or double-sided image reading is discharged through the discharge roller pair 81, 82 arranged at the exit of the third transport path 33 in a manner that the document set are discharged onto the discharge tray 80 in the same order of pages as having been stacked on the document tray 10.

Description of Projecting Tab

Figure 2:
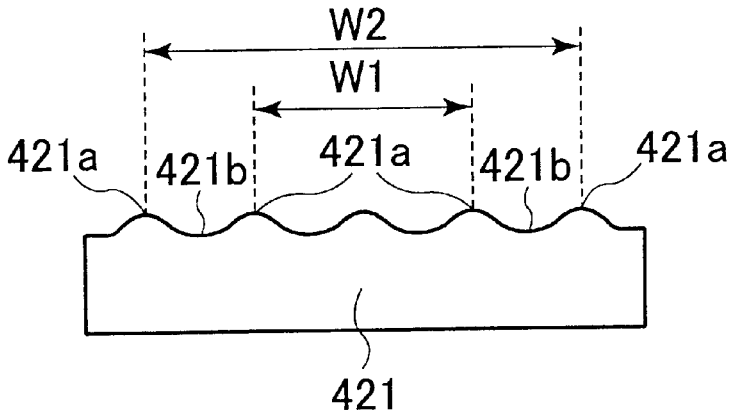
FIG. 2 is a front view of a projecting tab used in the sheet transport device.
Figure 3:
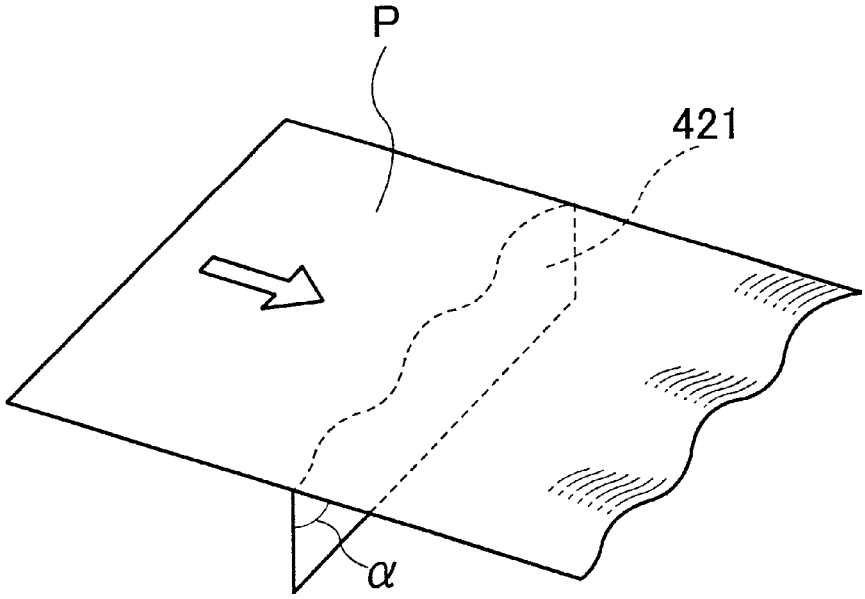
FIG. 3 is a diagram illustrating how the projecting tab makes contact with a sheet.
Figure 4:
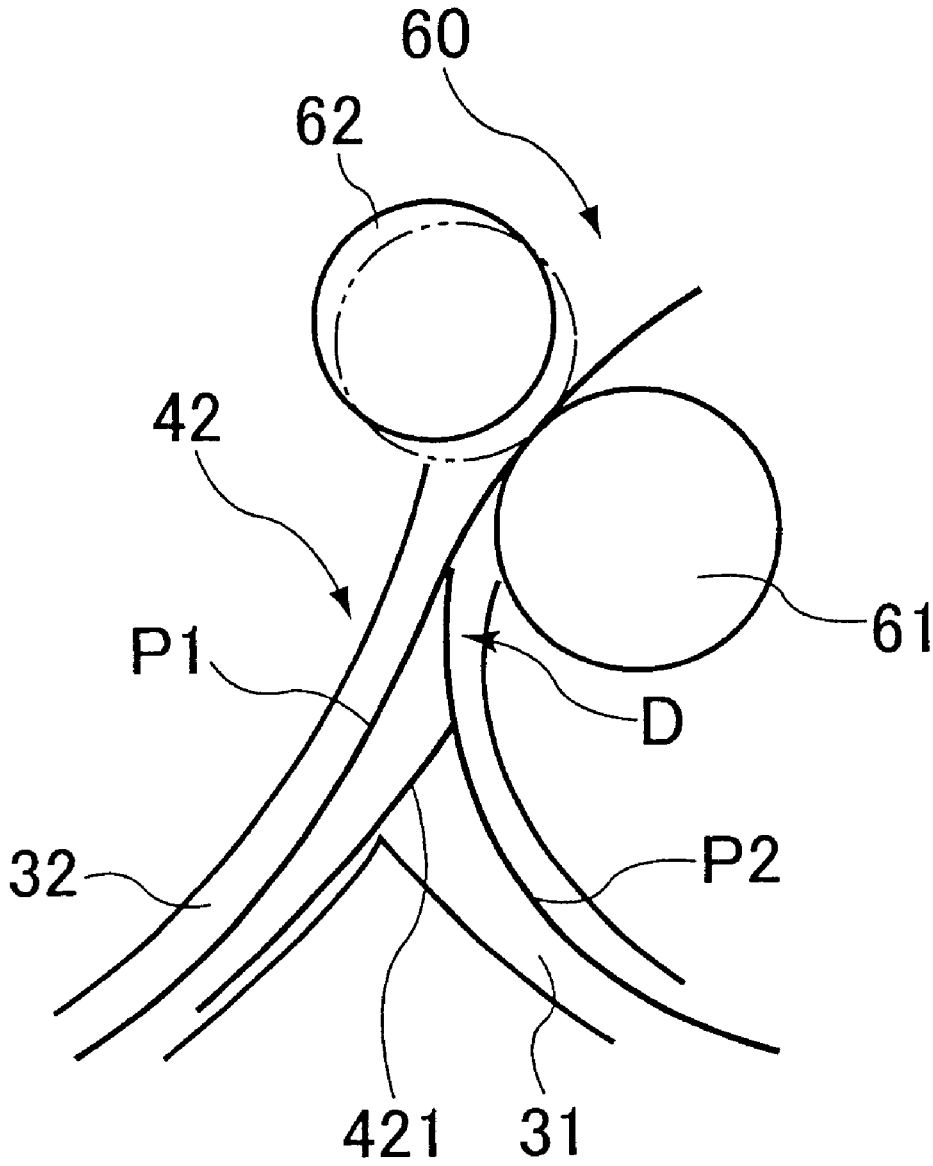
FIG. 4 is a diagram illustrating how sheets are transported in an overlap state in opposite directions in the vicinity of a second junction in the sheet transport device.

Now, an aspect of this invention is described on the projecting tab 421 with reference to FIGS. 2 to 4.

The projecting tab 421 shown in FIGS. 2 to 4 is provided in the second junction 42 as stated above. FIG. 2 is a front view of the projecting tab 421, FIG. 3 is a perspective view showing a state as to how a document P in contact with the projecting tab 421 is transported in the document transport direction shown by the arrow, and FIG. 4 is a diagram showing a state as to how a document P1 exiting from the document inverting section 60 and a document P2 entering the document inverting section 60 are transported in the opposite directions in an overlap state in the second junction 42.

The projecting tab 421 is made of a single plate-like member composed of a synthetic resin material such as polyethylene terephthalate having an elasticity. As shown in FIG. 2, an upper side of the projecting tab 421 is shaped into a wavy form similar to a sinusoidal wave including a series of recesses 421*b* and projections 421*a* formed alternately.

A lower part of the projecting tab 421 is mounted on the lower side wall constituting the second transport path 32, while the upper part thereof having the wavy configuration projecting inwardly in the second junction 42 at which the first transport path 31 and the second transport path 32 are connected.

The document P coming into the second junction 42 from the first transport path 31 is transported over the upper wavy part of the projecting tab 421 in contact therewith in a state that an obtuse contact angle $\alpha$ (>90°, see FIG. 3) is defined by an upward extending plane of the projecting tab 421 and a transport plane of the document P to securely guide the document P toward the document inverting section 60 located substantially above the second junction 42.

As shown in FIG. 3, the document P is transported over the projecting tab 421 in contact with the projections 421*a* (see FIG. 2) of the upper part of the projecting tab 421. Since the document P is transported in contact with the plural points (projections 421*a*) of the projecting tab 421 in a seemingly wavy state in the width direction of the document P substantially orthogonal to the document transport direction shown by the arrow, the document P is supported at the plural points. Thereby, the document P is hard to bend in the document transport direction. Thus, the configuration of the projecting tab 421 gives a transport backup force to the document P being transported in the document transport direction in contact therewith. The projecting tab 421 thus functions as a transport backup member for supplying a backup force to aid the transport of the document P.

The transport direction in the section from the first transport path 31 to the document inverting section 60 is substantially upward and, accordingly, the lead end of the document P in the entering direction into the document inverting section 60 is liable to droop due to the weight thereof. In this arrangement, however, since the lead end D of the document (document P2 in FIG. 4) in contact with the projecting tab 421 is applied with a sufficient backup force, the document P2 is enabled to be securely transported in the transport direction (in this case, substantially upward direction) without being stuck in the transport path.

Further, in the case where the sheet transport device is used in an image forming apparatus such as a copier, the following effect is obtained. Specifically, since the document P (in this case, copy paper) is shaped into a seemingly wavy configuration in the width direction thereof while being transported in contact with the plural points of the projecting tab 421, the contact area of the copy paper P with the transport planes constituting the first transport path 31 reduces. Thereby, a possibility that the copy paper P may be smeared due to frictional contact with the transport planes can be reduced.

In the sheet transport device having the above construction, the document P after one side image reading in double-sided image reading mode is fed to the image reading section 70 via the second transport path 32 after a switchback operation in the document inverting section 60, and then discharged onto the discharge tray 80. At this time, as shown in FIG. 4, the sheet transport device may be rendered into a state where a next document P2 of the document set is about to enter the document inverting section 60 from the first transport path 31 while the document P1 after one side image reading in double-sided image reading mode is about to exit from the document inverting section 60 to the second transport path 32.

This situation occurs in order to speed up the image reading by reducing an image reading interval between the successively transported documents and allowing the document P2 to be ready for an image reading while the document P1 is on the way of image reading. When the above situation occurs, the document P1 exiting from the document inverting section 60 to the second transport path 32 and the document P2 entering the document inverting section 60 from the first transport path 31 are transported in an overlap state in the opposite directions in the second junction 42.

In such a case, it is highly likely that the lead end of the document P2 in the entering direction is forcibly folded against a strong transport force of the document P1. In this embodiment, however, since the document P2 is given a sufficient backup force due to contact with the projecting tab 421, the document P2 is hard from being subject to a strong transport force of the document P1, thereby eliminating a problem such as an undesired folded state of the document.

As shown in FIG. 2, the projecting tab 421 is formed with the series of projections 421*a* in such a manner that the opposite lateral ends of the document (sheet) in the width direction thereof securely contact with any one of projection pair 421*a*, 421*a* depending on various widths W1, W2, . . . of standardized sizes of documents (sheets). Accordingly, the document P2 having contacted with the projection pair 421*a*, 421*a* results in a configuration that the opposite lateral ends of the document P2 in the width direction are slightly deflected away from the document P1 so that the documents P1, P2 do not contact with each other at the opposite lateral ends thereof. With this arrangement, there can be prevented a drawback that the corner end(s) of the lead end D of the document P2 may be undesirably folded due to contact with the document P1.

Further, in the case where the sheet transport device is used in an image forming apparatus such as a copier, the following effect is obtained. Specifically, since the document P2 (in this case, copy paper P2) is rendered into a seemingly wavy state in the width direction thereof after having contacted with the projecting tab 421, the contact area of the thus configured copy paper P2 with preceding copy paper P1 reduces, thereby reducing a degree of smear of the copy paper P2 due to undesirable contact with the copy paper P1.

The upper part of the projecting tab 421 has a substantially symmetrical with respect to the widthwise center thereof, as shown in FIG. 2. With this configuration, the document P having contacted with the projecting tab 421 is shaped into a seemingly symmetrically wavy configuration in the width direction thereof. This arrangement enables to obviate an undesirable resistance resulting from an asymmetrical contact with the projecting tab, thereby eliminating a possibility that the document may be obliquely transported resulting from such undesirable asymmetrical contact.

The upper end of the projecting tab 421 is formed into a smooth curved line without a pointed portion. This configuration serves to eliminate a problem that the document having contacted with the upper end of the projecting tab 421 may be formed with a streak or wrinkle in the transport direction.

Since the projecting tab 421 is made of an elastic material and is elastically deformable in contact with the document P, the document P is securely guided in a specified transport direction while in contact with the projecting tab 421 with a constant contact pressure.

Since the projecting tab 421 is made of a single plate-like member, mounting operation of the projecting tab 421 at a specified position in the second junction 42 is easy.

Note that the projecting tab 421 functions as a guide means for guiding the document (sheet) in such a manner that a document P transported from the first transport path 31 to the second junction 42 is guided to the upper-side-located document inverting section 60 and that the document P exiting from the document inverting section 60 to the second junction 42 is guided to the second transport path 32.

In the sheet transport device having the above arrangement, the projecting tab 421 not only serves as the transport backup member for supplying a sufficient backup force to securely transport the document P in a specified transport direction but also serves as the guide means, thereby reducing the number of parts constituting the entirety of the sheet transport device while reducing the production cost thereof.

Various Modifications of Projecting Tab

Now, modifications of the embodiment in which the projecting tab 421 is provided at different positions of the sheet transport device are described with reference to FIGS. 5A to 9B.

Figure 5A:
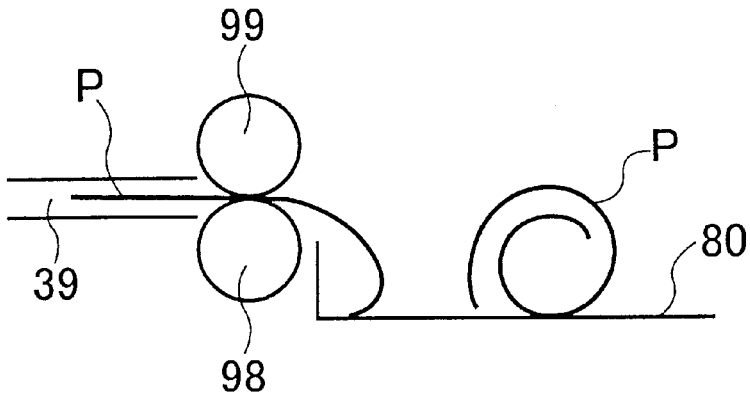
FIG. 5A is a diagram of an example of sheet transport being discharged through an exit of a transport path having a possibility of sheet transport failure.
Figure 5B:
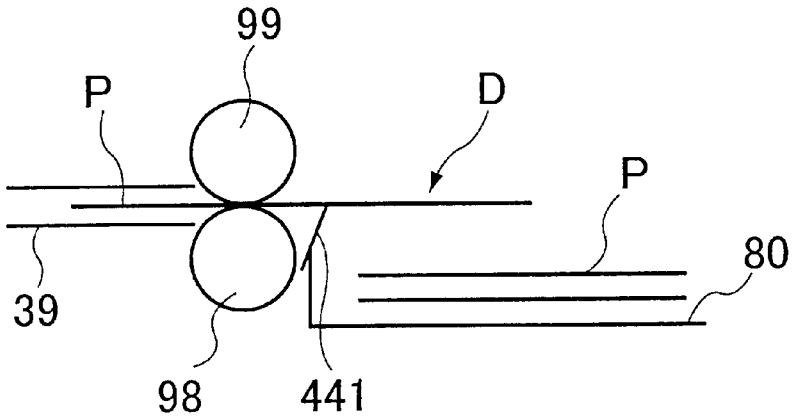
FIG. 5B is a diagram of an example where the projecting tab is provided in the vicinity of the exit of the transport path to eliminate a possible sheet transport failure in FIG. 5A.

FIGS. 5A and 5B are diagrams showing an example that a sheet P such as copy paper and document is being discharged onto a discharge tray 80 via the space defined by a discharge roller pair 98, 99 through the exit of a transport path 39. It is highly likely that the sheet P being discharged is curled up, as shown in FIG. 5A, during the transport within the transport path 39, thus obstructing a smooth discharge and resulting in failure of stacking the sheet set properly in the order of pages. Thereby, an operator may find it difficult to take out the sheet set stacked on the discharge tray 80. In a worse case, the curled-up sheet P may fall off from the discharge tray 80.

It may be preferable to provide a projecting tab 441 in the vicinity of the exit of the transport path 39 to eliminate the above problem and smoothly discharge the sheet P onto the discharge tray 80.

Specifically, providing the projecting tab 441 near the exit of the transport path 39 enables to give such a sufficient transport backup force to the sheet P as to allow the lead end D of the sheet P (see FIG. 5B) to pass through the space of the discharge roller pair 98, 99 in a straightened-up state while transported along the transport path 39 and securely allow the sheet P to land onto the discharge tray 80. The sheet P is transported in a straightened-up state substantially horizontally over the discharge tray 80. Thereby, even if the sheet P is temporarily formed with a curled portion during the transport along the transport path 39, the curled-up state of sheet P can be properly corrected while transported over the projecting tab 441, thereby being discharged onto the discharge tray 80 in a straightened-up state one over another.

Particularly, since the projecting tab 441 is rendered in contact with the sheet P to support the sheet P from below as the sheet P is being discharged onto the discharge tray 80, the sheet P can securely land over the discharge tray 80 substantially horizontally.

Figure 6A:
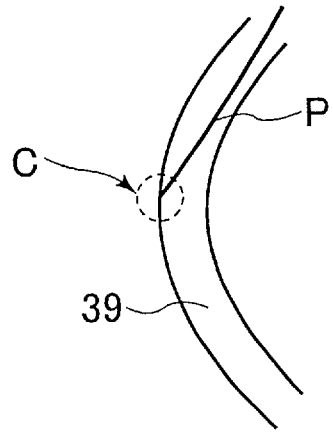
FIG. 6A is a diagram of an example of sheet transport in a curved portion of a transport path having a possibility of sheet transport failure.
Figure 6B:
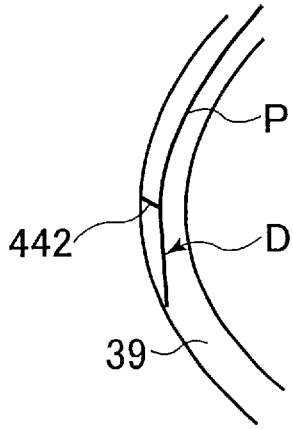
FIG. 6B is a diagram of an example where the projecting tab is provided in the curved portion of the transport path to eliminate a possible sheet transport failure in FIG. 6A.

FIGS. 6A and 6B are diagrams showing an example that a transport path 39 has a curved portion. As shown in FIG. 6A, in the curved portion, it is difficult to transport the sheet P in conformity with the curved configuration of the transport path 39 with a result that the sheet P may be stuck against the transport plane around an area indicated by the dashed circle C in FIG. 6A. As a result, the lead end of the sheet P in the transport direction may be liable to bend.

Providing a projecting tab 442 at a specified position of the curved portion of the transport path 39, as shown in FIG. 6B, is preferable to eliminate the above problem.

Specifically, providing the projecting tab 442 projecting inwardly in the transport path 39 at a position of the curved portion of the transport path 39 enables to feed the lead end D of the sheet P in a desired transport direction in a straightened-up state due to a sufficient transport backup force by the projecting tab 442. Thereby, a possibility that the sheet P may be stuck against the transport plane of the transport path 39 is eliminated with a result that a bent lead end of the sheet P can be obviated.

Figure 7A:
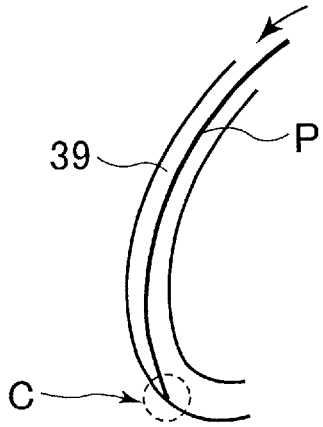
FIG. 7A is a diagram of an example of sheet transport in a transport path having a transport plane where the radius of curvature varies with a possibility of sheet transport failure.
Figure 7B:
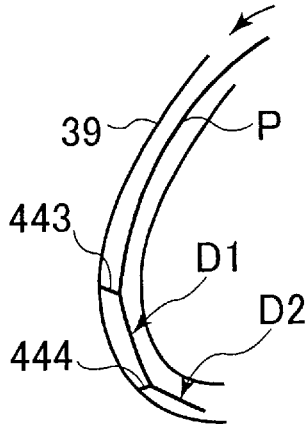
FIG. 7B is a diagram of an example where the projecting tab is provided in the transport path shown in FIG. 7A to eliminate a possible sheet transport failure in FIG. 7A.

FIGS. 7A and 7B are diagrams showing an example that a transport path 39 has different radii of curvature portion by portion. As shown in FIG. 7A, it is highly likely that the sheet P may be stuck against the transport plane around an area indicated by the dashed circle C in FIG. 7A owning to a transport failure in conformity with the curved portion of the transport path 39. Consequently, the lead end of the sheet P may be liable to bend. Particularly, it is often the case that the above phenomenon occurs in an area where a change of radius of curvature takes place, from a greater radius to a smaller radius as shown in FIG. 7A.

Providing plural projecting tabs 443, 444 at specified positions on the area where the radius of curvature varies in the transport path 39 enables to eliminate the above problem.

Specifically, providing the plural projecting tabs 443, 444 in combination following the configuration of the transport path 39 having different radii of curvature enables to transport the sheet P in conformity with the curved shape of the transport path 39. Thereby, a problem that the sheet P may be stuck against the transport plane or subjected to frictional resistance against the transport plane of the transport path 39 can be eliminated.

It should be noted that in this modification, the projecting tabs 443, 444 are provided on the transport path 39 where the radius of curvature gradually decreases (curve gets sharper). Alternatively, the modification may be applied to an area of the transport path 39 where the radius of curvature increases (curve gets gentler).

Figure 8A:
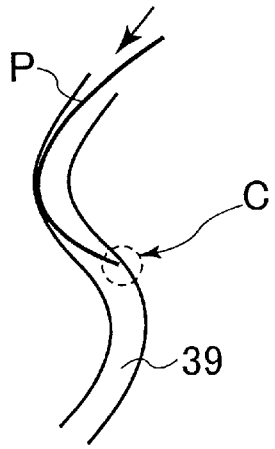
FIG. 8A is a diagram of an example of sheet transport in a S-curved section of a transport path having a possibility of sheet transport failure.
Figure 8B:
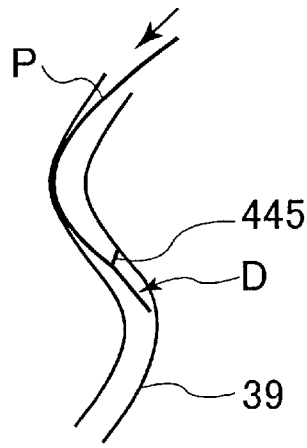
FIG. 8B is a diagram of an example where the projecting tab is provided in the S-curved section of the transport path shown in FIG. 8A to eliminate a possible sheet transport failure in FIG. 8A.

FIGS. 8A and 8B are diagrams showing an example where a transport path 39 is formed into a S-curve. As shown in FIG. 8A, it is highly likely that the sheet P may be stuck against the transport plane at a latter half section of the S-curve (see the area C shown by the dashed circle in FIG. 8A) due to the curled lead end of the sheet P resulting from transport along a first half section of the S-curve.

Providing a projecting tab 445 at a position on an area including a substantially turning point of the S-curve jointing the first half section and the latter half section enables to eliminate the above problem.

Specifically, providing the projecting tab 445 before the turning point of the S-curve of the transport path 39 enables to feed the lead end D of the sheet P in a straightened-up state in the transport direction along the latter half section in contact with the projecting tab 445 even if the lead end D of the sheet P is temporarily curled up during the transport along the first half section. Thereby, a possibility that the sheet P may be stuck against the transport plane of the latter half section of the transport path 39 can be suppressed.

Figure 9A:
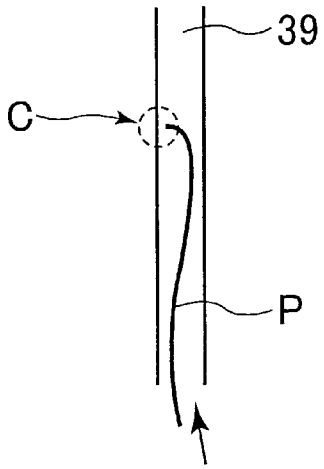
FIG. 9A is a diagram of an example of sheet transport in a transport path for guiding a sheet upwardly having a possibility of sheet transport failure.
Figure 9B:
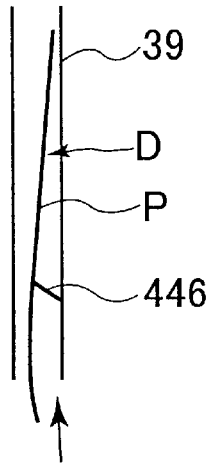
FIG. 9B is a diagram of an example where the projecting tab is provided in the transport path shown in FIG. 9A to eliminate a possible sheet transport failure in FIG. 9A.

FIGS. 9A and 9B show an example where a sheet P is transported on a transport path 39 extending substantially upwardly. In this modification, as shown in FIG. 9A, it is highly likely that the lead end of the sheet P in the transport direction may be drooped due to its weight. Consequently, the lead end of the sheet P may bend while stuck against the transport plane of the transport path 39.

Providing a projecting tab 446 in the transport path 39 in such a manner as shown in FIG. 9B enables to eliminate the above problem.

Specifically, providing the projecting tab 446 in the transport path 39 as shown in FIG. 9B enables to apply the lead end D of the sheet P having contacted with the projecting tab 446 a sufficient transport backup force which feeds the sheet P substantially upwardly and straightforwardly. Thereby, a problem that the lead end D of the sheet P may be drooped is eliminated with a result that a problem that the lead end D is stuck against the transport plane can be prevented.

Now, varied shapes of the projecting tab projecting inwardly in the transport path are described with reference to FIGS. 10A to 14.

Figure 23:
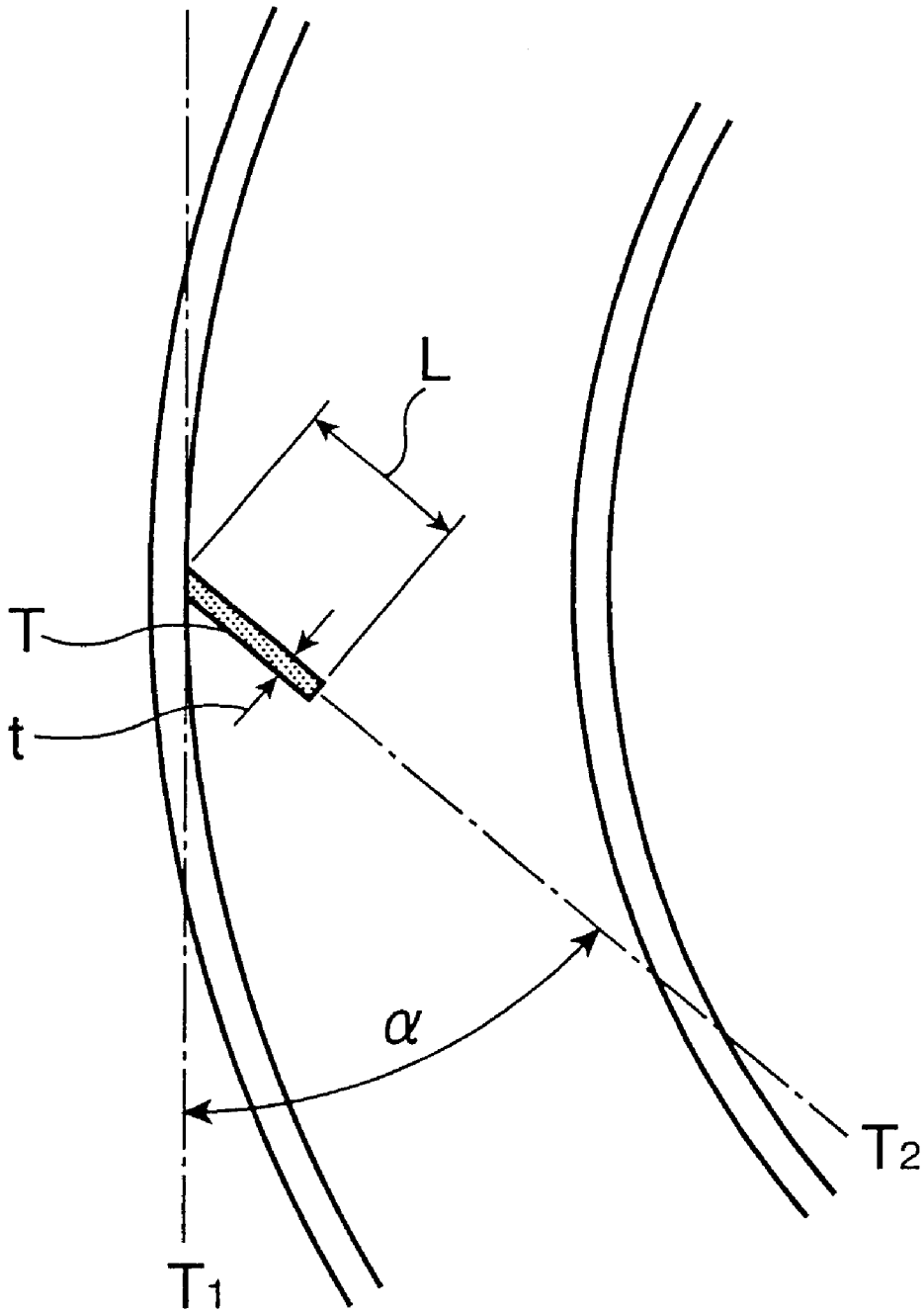
FIG. 23 is a diagram showing one example of arrangement of a projecting tab with respect to a sheet transport path.

It should be noted that in order to sufficiently and adequately apply a backup force to the sheet passing over the projecting tab "T", a material "M", a projection amount "L", a thickness "t" and an angle "$\alpha$" of the projecting tab "T" need to be determined depending upon the nature and the condition of the transport path, i.e., a degree of radius of curvature. Taking FIG. 23 condition as an example, "L" is defined as a projection amount of the projecting tab T from the surface of the transport path and "$\alpha$" is defined as an angle between a tangential line T1 and an extending line T2 along the projecting tab T. The backup force attained in the sheet passing over the projecting tab T is a function of the variables M, L, t, and $\alpha$ assuming a speed of the sheet passing over the projecting tab T is of substantially a constant value. The inventors found out, after having conducted experiments, "polyethlene terephthalate (PET)" is suitable for a material of the projecting tab with the following dimensions:

for a thickness "t": a value in a range of 0.08 mm to 0.12 mm is preferred;

for a projecting amount "L": at least 1–2 mm is required for an angle "$\alpha$": a value in a range of 30 degrees to 90 degrees is required to apply a sufficient transport backup force in a sheet transport direction along a sheet path. In addition, the material, PET, was selected also because of its cost and a sufficient durability against the repetitive use taking into account the required fatigue strength. It is acknowledged that any other material having the mechanical property similar to PET can be used as the projecting tab of this invention.

FIGS. 10A to 10E are diagrams respectively showing projecting tabs 451 to 455 each made of a single plate-like elastic member formed with a recess in one side thereof. As shown in the figures, as long as the recesses formed in the projecting tabs 451 to 455 have such a shape as to form a seemingly wavy surface on the sheet P in the width direction thereof, any type of the projecting tabs 451 to 455 may be adopted.

Figure 10A:
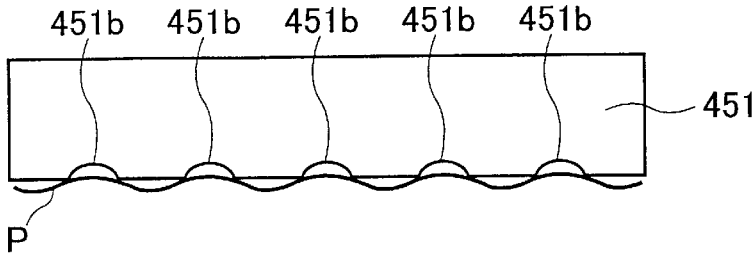
FIGS. 10A to 10E are diagrams respectively showing varied shapes of the projecting tab formed with a recess to form a contact portion with a sheet.
Figure 10B:
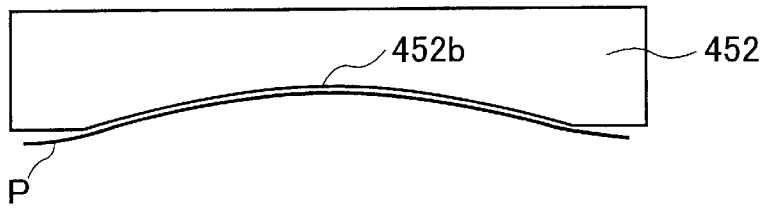
Figure 10C:
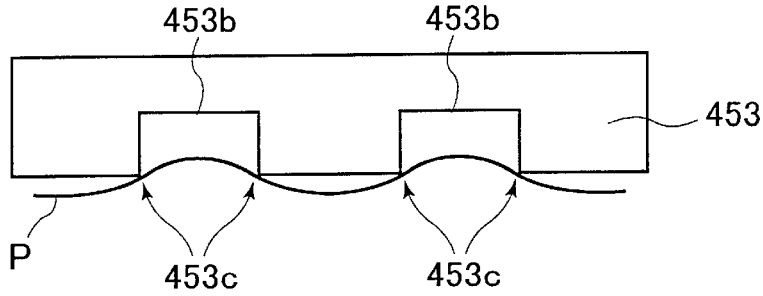
Figure 10D:
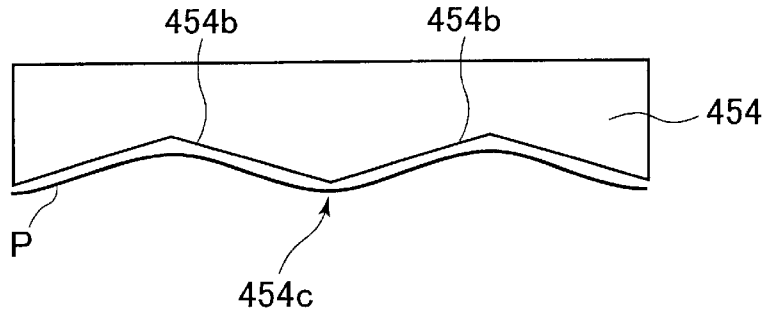
Figure 10E:
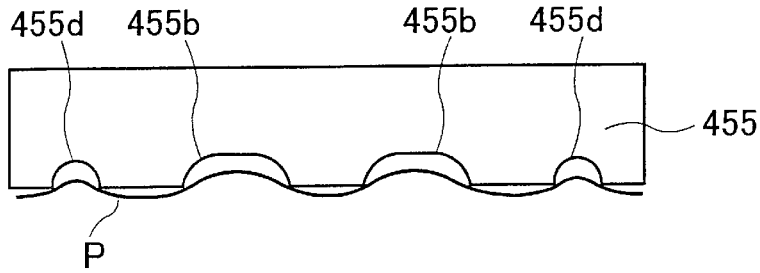

Specifically, in FIG. 10A, the recess of the projecting tab 451 consists of a series of circular arc indents 451*b*, in FIG. 10B, the recess of the projecting tab 452 consists of a single circular arc recess 452*b*, in FIG. 10C, the recess of the projecting tab 453 consists of a pair of square-shaped indents 453*b* viewed from above the plane of FIG. 10C, in FIG. 10D, the recess of the projecting tab 454 consists of a pair of triangular-shaped indents 454*b* viewed from above the plane of FIG. 10D, and in FIG. 10E, the recess of the projecting tab 455 consists of pairs of indents with the indent pairs having different configuration to each other.

It may be preferable to form corner ends 453*c* of the indent 453*b* (joint end 454*c* connecting the indents 454*b*) into a curved shape to prevent a streak or wrinkle from being generated in the transport direction on the surface of the sheet P, which have been formed while in contact with pointed corner ends (joint end), unless such countermeasures should be taken.

Figure 11A:
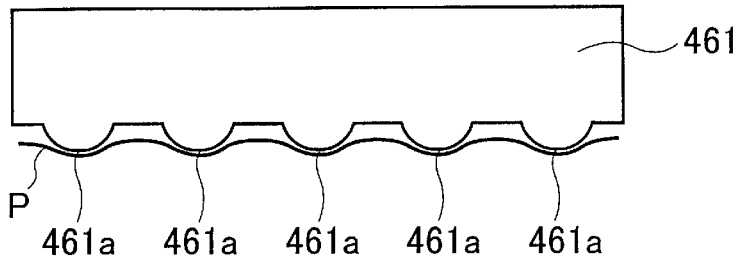
FIGS. 11A & 11B are diagrams respectively showing varied shapes of the projecting tab formed with a bulged portion to form a contact portion with a sheet.
Figure 11B:
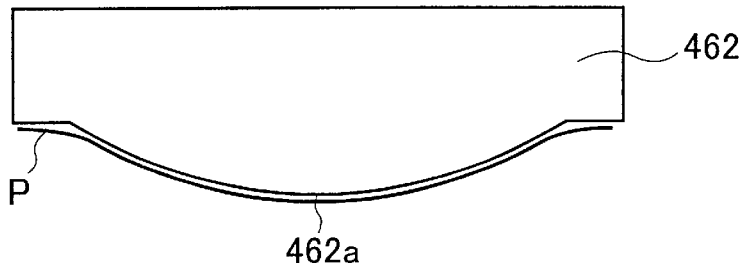

FIGS. 11A and 11B are diagrams showing an example where projecting tabs 461, 462 each consist of a single plate-like elastic member with a bulged portion formed on one side thereof. The bulged portion may consist of a series of projections 461*a* as shown in FIG. 11A or may consist of a single projection 462*a* as shown in FIG. 11B. Forming the projections 461*a* (or projection 462*a*) enables to render the sheet P primarily in contact with the distal end of the projections 461*a* (or projection 462*a*) including a portion nearby. As a result, even if the base end of the projections 461*a* (or projection 462*a*) may be cut away with an acute angle, this arrangement makes it possible to suppress a possibility that the sheet P may be formed with a streak or wrinkle in the sheet transport direction, which is desirable in the aspect of sheet transport.

Figure 12A:
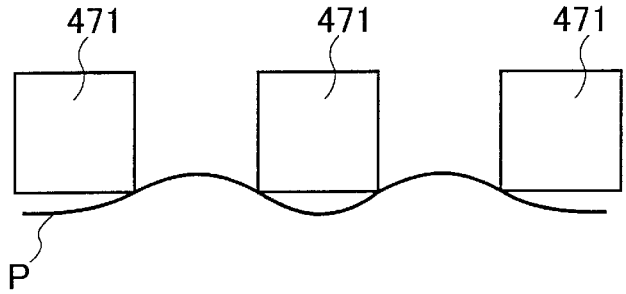
FIGS. 12A to 12C are diagram respectively showing examples of the projecting tab formed with an array of projecting pieces.
Figure 12B:
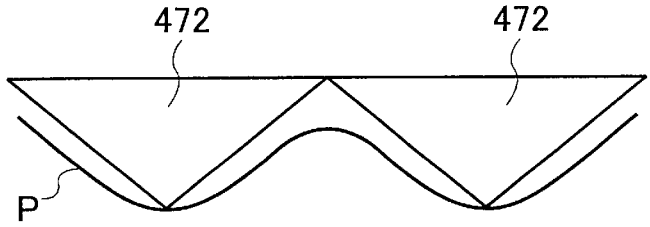
Figure 12C:
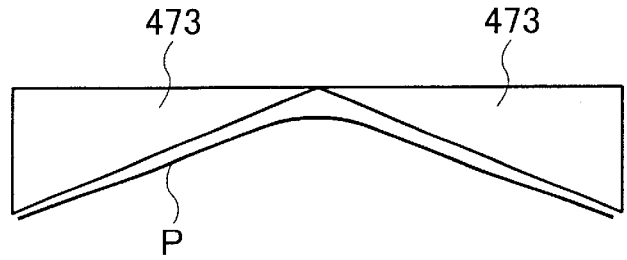

FIGS. 12A to 12C are diagrams showing an example where an array of plate-like elastic members (projecting pieces) 471 (472, 473) constitute a projecting tab. The projecting tab may consist of an array of square-shaped pieces 471 as shown in FIG. 12A or an array of triangular-shaped pieces 472 (or 473) as shown in FIG. 12B (or 12C) with the pieces arrayed side by side in the width direction of the projecting tab. Providing the array of projecting pieces in the manner as shown in FIGS. 12A to 12C enables to reduce the space for the projecting pieces 471 (472, 473) with respect to the width size of the transport path. Further, the projecting pieces 471 (472, 473) can be made of the same configuration which contributes to production cost reduction of the projecting tab.

Figure 13:
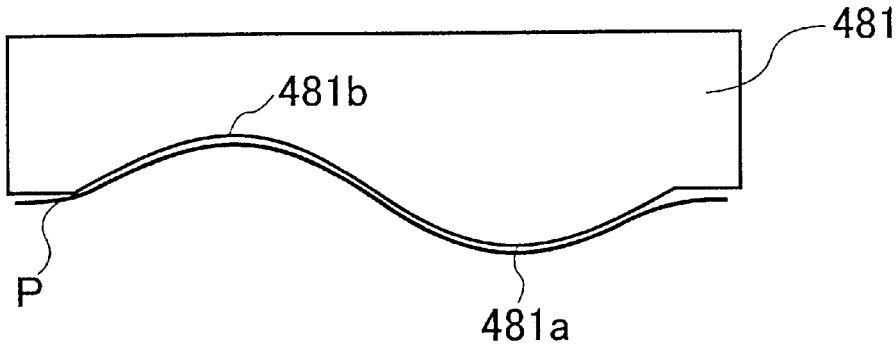
FIG. 13 is a diagram of an example of the projecting tab formed with a contact portion bulging asymmetrically with respect to a width direction of the projecting tab.

FIG. 13 is a diagram showing an example of a projecting tab 481 formed with a bulged portion 481*a* and an indent 481*b*. As shown in FIG. 13, the bulged portion may not be necessarily symmetrical with respect to the width direction of the projecting tab 481 (i.e., symmetrical in a direction orthogonal to the width direction of the projecting tab 481).

Figure 14:
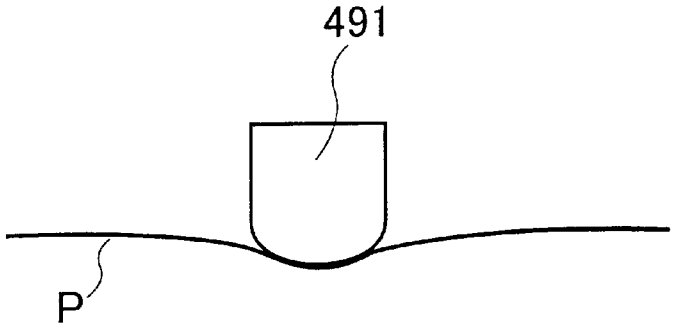
FIG. 14 is a diagram of an example of the projecting tab so constructed as to make contact with part of a sheet in the width direction thereof.

FIG. 14 is a diagram showing an example of a projecting tab 491 so constructed as to make contact with a substantially intermediate part of the sheet P in the width direction thereof. As shown in FIG. 14, as far as the projecting tab enables to form a seemingly wavy surface of the sheet P, the contact portion of the projecting tab may not be necessarily formed over the widthwise entirety of the projecting tab but may be partially formed in the width direction thereof.

In the aforementioned embodiment, the projecting tab is made of a synthetic resin. As an altered form, the projecting tab may be made of a deformable material including a variety of metallic materials such as iron and aluminum. Also, a wood piece having a relatively small elastic deformation may be usable as the projecting tab.

In the embodiment, the projecting tab is made of a flat plate-like member. As far as the projecting tab is formed with a contact portion having such a shape as to make a seemingly wavy surface of the sheet in contact therewith, the projecting tab may have a certain thickness or have different thickness in the width direction thereof.

Arrangement of Image Reading Section

Figure 15:
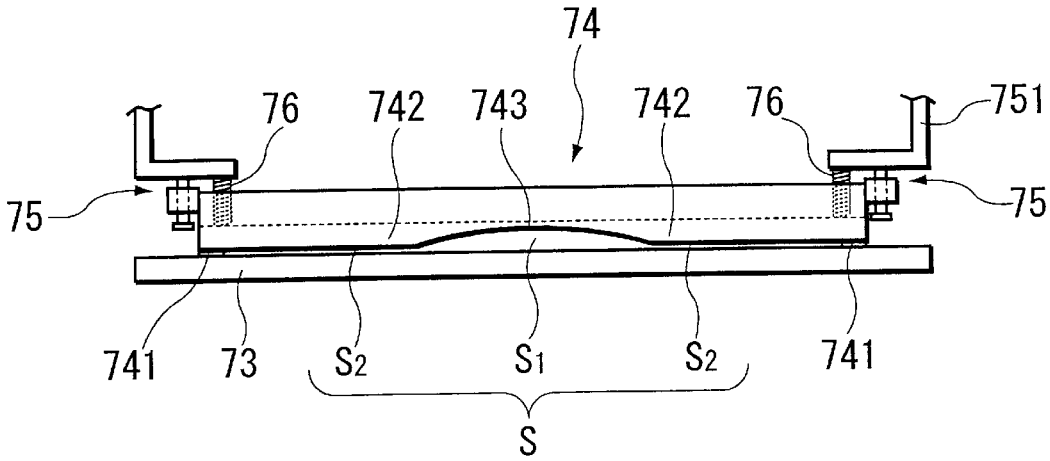
FIG. 15 is a front view of an image reading section of the document image reader.
Figure 16:
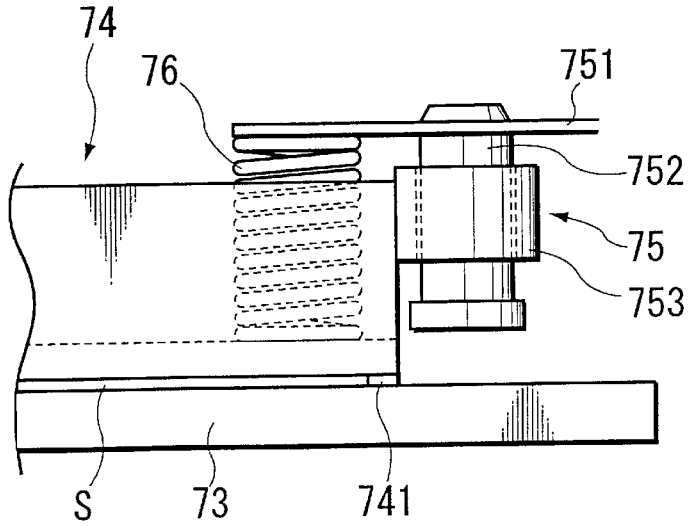
FIG. 16 is a partially enlarged view of the image reading section.
Figure 17:
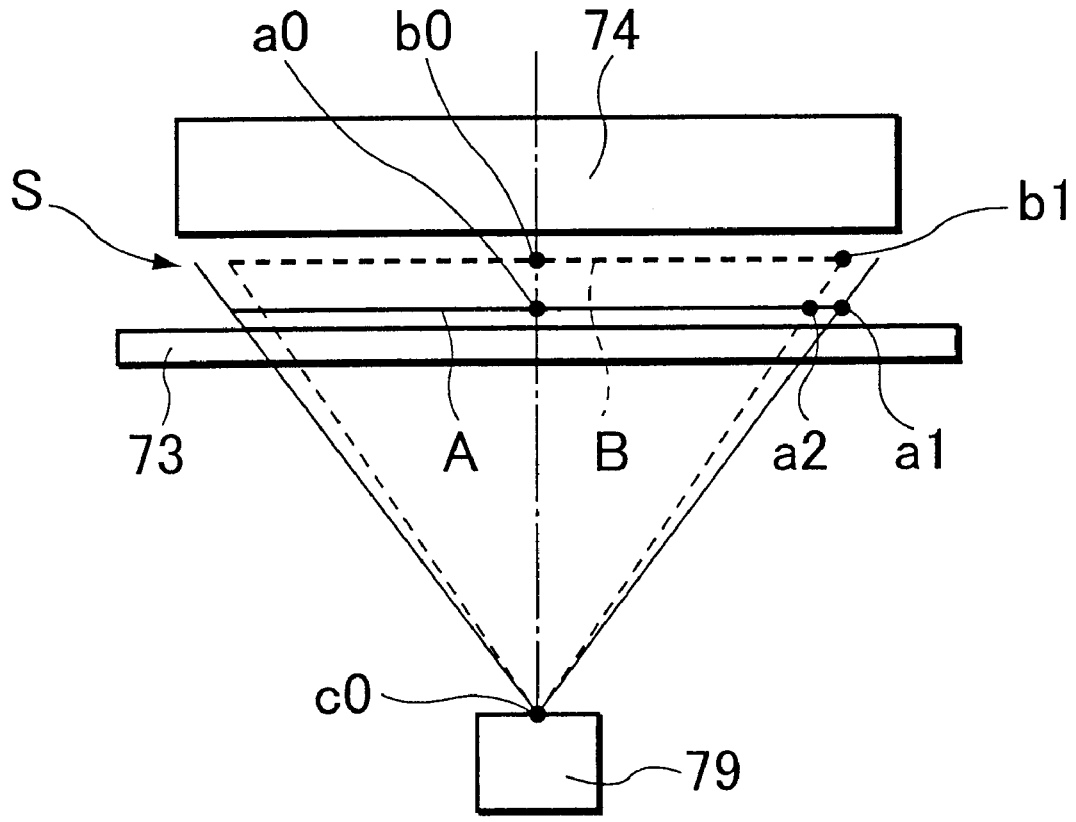
FIG. 17 is a diagram explaining a mechanism of causing an image distortion in image reading by the image reading section.
Figure 18B:
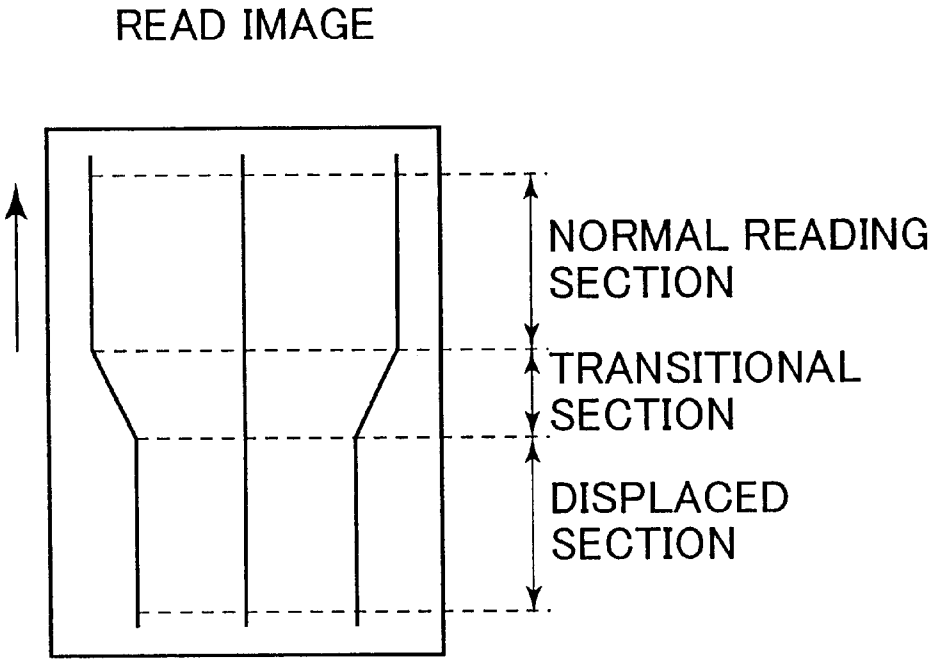
FIG. 18B is a diagram of an example of a read image obtained by reading the original image of FIG. 18A having an image distortion.

Now, another aspect of this invention is described concerning the image reading section 70 shown in FIG. 1 referring to FIGS. 15 to 18B. FIG. 15 is a front view partially showing the image reading section 70 around the image reading position 71 viewed from the right side in FIG. 1, FIG. 16 is an enlarged front view showing a right side portion of the image reading section 70 in FIG. 15, FIG. 17 is a diagram illustrating the principle of causing an image reading failure at the image reading position 71, and FIGS. 18A and 18B are diagrams comparatively illustrating an example of an original image and a read image having an image distortion.

As described above in the section of the document image reader, the document image reader shown in FIG. 1 is operated such that an image is read as the document (sheet) P is being transported over the image reading position 71. In such an image reader, if a clearance S defined by a pair of transport planes corresponding to the upper surface of the contact glass 73 and the lower surface of the guide member 74 around the image reading position 71 is undesirably large, the sheet transport sliding over the image reading position 71 fluctuates up and down within the large clearance S, thereby leading to a possible image reading failure.

For instance, assuming that the level shown by the solid line A in FIG. 17 is a normal reading level, whereas the position shown by the dashed line B in FIG. 17 is a deviated level displaced above the normal reading level A relative to the upper surface of the contact glass 73. Observing a document (not shown in FIG. 17) sliding over the contact glass surface, for example, when the document is supposed to pass the normal reading level A, the right end of the document is located at the position a1. On the other hand, when the document is supposed to pass the deviated level B, the right end of the document is located at the position b1.

When the image reading of the document passing the deviated level B is observed from the side of the lens 79, an image on the right end of the document, which is supposed to be read at the position al when the document passes the normal reading level A, is read at the position a2 of the normal reading level A. Consequently, the image on the right end of the document is read as if the image moves back and forth in the width direction of the document (left and right directions in FIG. 17) as the document is transported up and down in a fluctuating state between the levels A and B in the clearance S. What is obtained from this image reading is a distorted image in the width direction of the document.

Figure 18A:
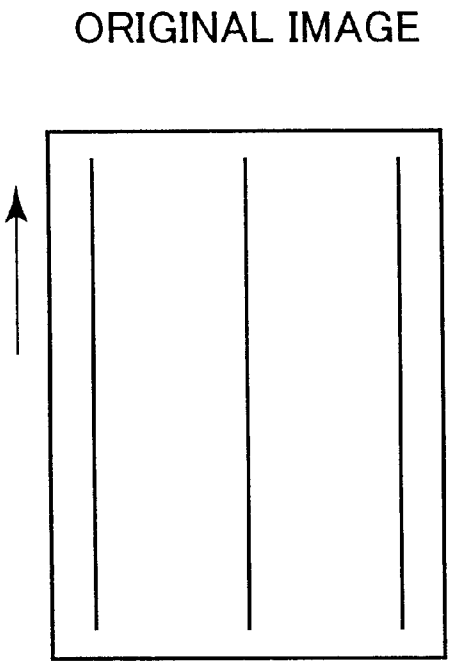
FIG. 18A is a diagram of an example of a document having an original image.

Specifically, if a document has an original image of three parallel lines in the document transport direction shown by the arrow in FIG. 18A, what is read from this document when an image reading is undesirably shifted from the normal reading level A to the deviated level B is an image shown in FIG. 18B. In FIG. 18B, the parallel lines on a leading section (normal reading section) in the transport direction are properly read in conformity with the original image because the document is transported at the normal reading level A. Then, the parallel lines on an intermediate section (transitional section) are deflected such that the outermost two lines get closer as the image reading level is shifted from the normal reading level A to the deviated level B. Finally, the distance between the parallel lines on a last section (displaced section) is narrowed because the document is transported at the deviated level B.

In order to accurately read an original image, it is desired to precisely set the document passing level on or around the image reading position 71 while setting the clearance S at the image reading position 71 as small as possible.

Exceedingly reducing the clearance S at the image reading position 71, however, undesirably increases a frictional resistance caused by transport of the document in contact with the transport planes defining the clearance S, which would generate an excessive transport load and obstruct a smooth document transport. When an excessive transport load is generated during the document transport, the document transport speed undesirably varies with a result that an image is distortedly read in the document transport direction.

In view of the above, the inventors of this invention investigated the mechanism of causing an image reading failure in association with an undesirable level fluctuation of the document passing over the contact glass surface at the image reading position 71 and invented an arrangement which effectively eliminates the image reading failure while securing a sufficient clearance S at the image reading position 71 free from an excessive transport load.

Specifically, the arrangement according to an aspect of this invention has been made based on the fact that the farther the image reading position is away from the center in the width direction of the document, the more the image reading distortion occurs between the normal image reading level A and the deviated level B. As is obvious from FIG. 17, the middle position b0 of a sheet on level B lies substantially on a light projection line connecting a middle point a0 of a sheet on level A and a point c0 on the lens 79. However, a right end point b1 of the sheet on level B is on the light projection line connecting a point a2 of the sheet on level A and the center point c0 of the lens 79. The point a2 is inward from the right end point al of the sheet on level A.

Hereinafter, the construction of the image reading section 70 according to the above aspect of this invention is described referring to FIGS. 15 and 16.

As shown in FIGS. 15 and 16, the opposite widthwise ends of the document guide 74 of the sheet transport device are respectively mounted on side plates 751, 751 which are fixed on a frame (not shown) via slide guide means 75, 75 and bias means 76, 76.

The slide guide means 75, 75 are adapted to fix the document guide 74 in back and forth directions (directions orthogonal to the plane of FIGS. 15 and 16) and left and right directions in FIGS. 15 and 16 (width direction of the document guide 74 corresponding to the width direction of the document) while slidably supporting the document guide 74 up and down. Specifically, as shown in FIG. 16, the slide guide means 75, 75 include guide members 753, 753 (only one guide member is shown in FIG. 16) mounted on the opposite widthwise ends of the document guide 74, and pivot shafts 752, 752 (only one pivot shaft is shown in FIG. 16) mounted on the side plates 751, 751 in such a manner as to pass through the guide members 753, 753, respectively.

The bias means 76, 76 are adapted to urge the document guide 74 downward. Each of the bias means 76 includes an elastic spring with the opposite ends thereof in contact with the side plate 751 and the inner bottom surface of the document guide 74, respectively.

Projections 741, 741 having a certain thickness are provided at the opposite widthwise ends on the lower surface of the document guide 74 which is urged downward by the bias means 76, 76. The document guide 74 is elastically pressed against the contact glass 73 via the projections 741, 741. With this arrangement, the clearance S is secured by the height corresponding to the thickness of the projection 741 between the document guide 74 and the contact glass 73.

The opposite widthwise ends on the lower surface of the document guide 74 are substantially horizontal, and a substantially intermediate part thereof is formed with a substantially inverted U-shaped recess 743. The clearance S defined by the above configuration of the lower surface of the document guide 74 and the upper surface of the contact glass 73 substantially includes a wider intermediate clearance S1 having a relatively large height and narrow end clearances S2, S2 formed at the opposite widthwise ends of the document guide 74 having a relatively smaller height than the intermediate clearance S1. For example, the height of the intermediate clearance S1 is about 1 mm, and that of the end clearance S2 (S2) is about 0.5 mm if the thickness of a sheet such as a document P commercially available is set about 0.1 mm or less.

With this arrangement, the document P being transported through the clearance S over the image reading position 71 has its movement restricted by the narrow clearances S2, S2, thereby securely preventing a possibility that the opposite ends of the document P may be undesirably lifted up above a certain level while transported over the contact glass 73. An image distortion is particularly conspicuous with respect to the opposite ends of the document P as explained above. This arrangement effectively prevents an occurrence of image distortion at the opposite widthwise ends of the document P and secures an accurate image reading.

The wider clearance S1 is formed at the substantially intermediate part of the clearance S at the image reading position 71, which contributes to a remarkable reduction of transport load which may be exerted to the intermediate part of the document P in the width direction thereof if such configuration should not be formed. Consequently, the transport load exerted on the entire surface of the document P can be minimized, thereby accomplishing a smooth document transport over the image reading position 71.

More specifically, in the arrangement of the image reading section 70 thus constructed, for the opposite widthwise ends of the document P where a large image distortion is likely to be generated in image reading, the narrow clearances S2, S2 are provided to restrict lifting up of the opposite widthwise ends of the document P, thereby effectively preventing an image distortion, while for the intermediate part of the document P which is less subjected to image distortion, the wider clearance S1 is provided to reduce the transport load, thereby accomplishing a smooth document transport.

Accompanied by suppression of the up and down fluctuation of the opposite widthwise ends of the document P, up and down fluctuation of the intermediate part of the document P is also suppressed due to a tension force applied from the opposite ends. As a result, the transport height level of the document P in its entirety stabilizes at a certain level above the contact glass 73. This arrangement enables to contribute to an accurate image reading since the focal distance in image reading is set constant when observing the document P passing the image reading position 71 right below the contact glass 73.

In this embodiment, the slide guide means 75, the bias means 76, and the projecting tab 741 constitute a mechanism for establishing a relative positional relation of the document guide 74 to the contact glass 73. Alternatively, any known means may be used to accomplish a similar effect as the mechanism described in this embodiment as far as such means can form the clearance S so defined by the document guide 74 and the contact glass 73.

In this embodiment, the lower surface of the document guide 74 is formed with the substantially horizontal opposite ends and the inverted U-shaped intermediate recess. Alternatively, as far as the lower surface of the document guide 74 is so constructed as to reduce the clearance from the intermediate portion toward the widthwise opposite ends of the document guide 74, any configuration may do including an example that the lower surface of the document guide 74 has a continuous slope shaped into a substantially inverted U-shape in its whole widthwise length.

In this embodiment, the document guide 74 is made of a one-piece unit having the U-shaped recess at the substantially intermediate portion on the lower surface thereof. As an altered form, the document guide 74 may consist of plural members such that a guide body having a substantially flat lower surface and a pair of elastic members mounted at the opposite ends on the lower surface of the guide body to narrow the clearance defined by the upper surface of the contact glass 73 and the lower surface of the document guide 74 constitute a document guide unit.

Construction of Switchback Route

Figure 19:
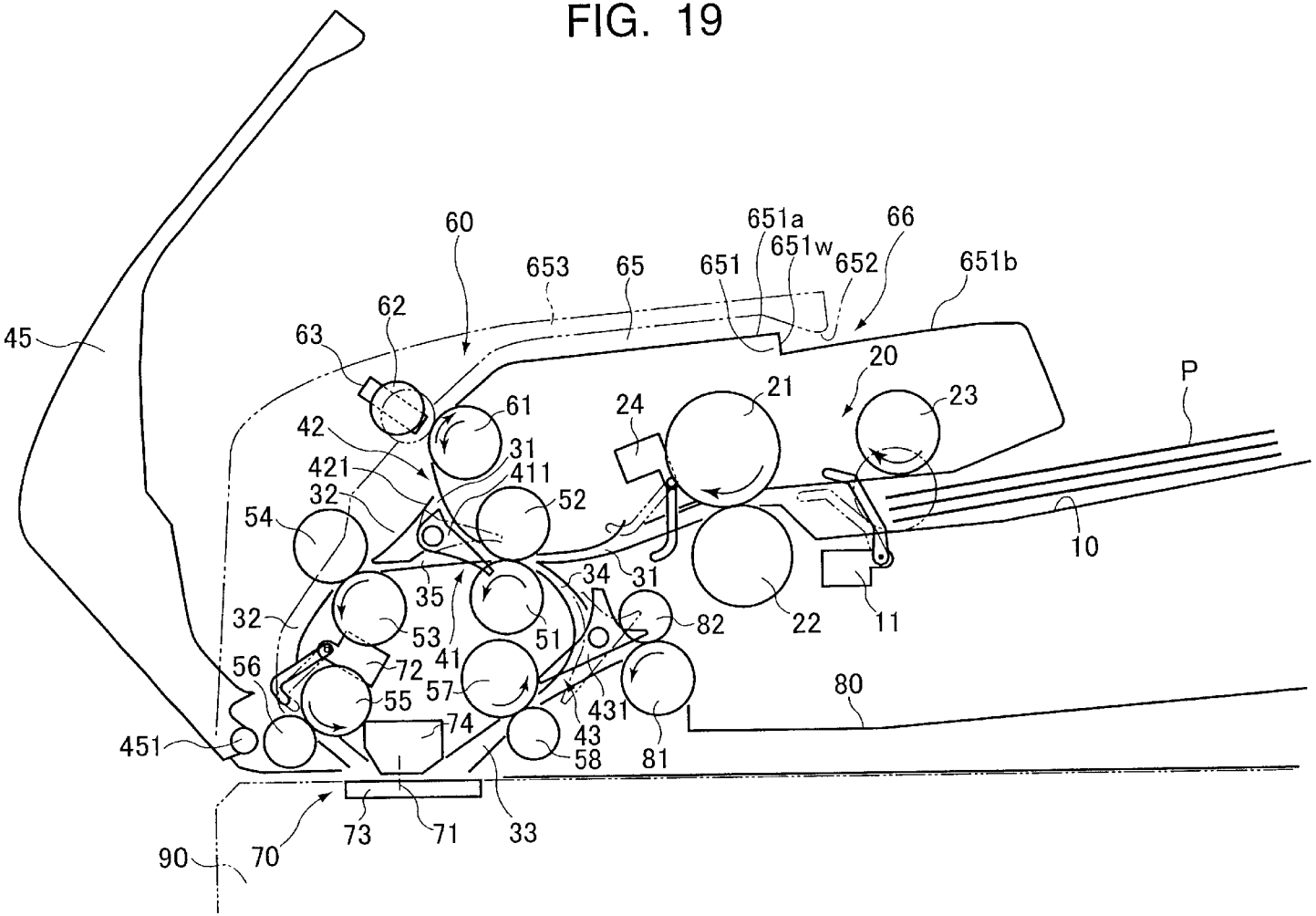
FIG. 19 is a schematic diagram of the document image reader showing a state that an outer cover of the document image reader is opened.
Figure 20:
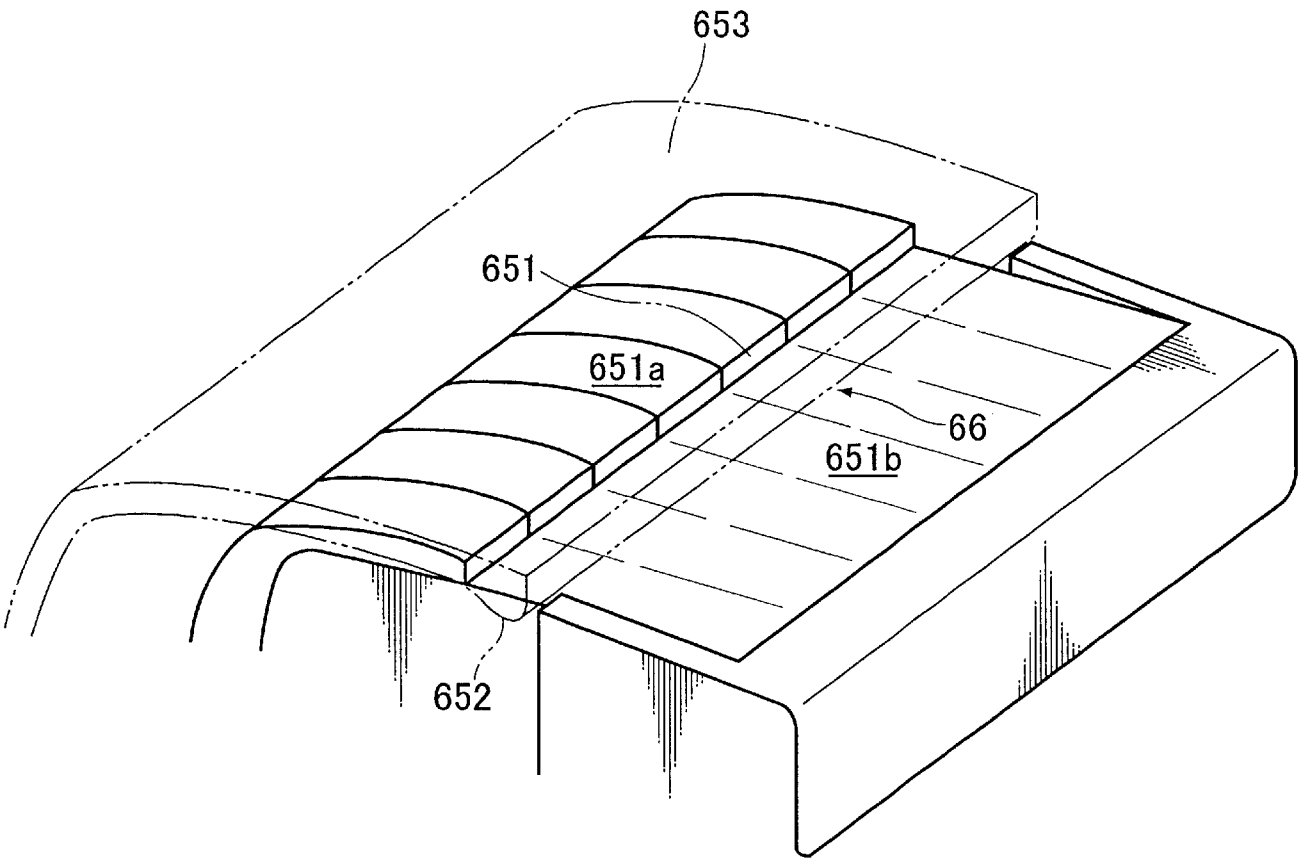
FIG. 20 is a perspective view near an opening of a switchback route of the document image reader, specifically showing a stepped portion formed on a lower wall constituting the switchback route in a state that an upper cover (shown by the broken line) constituting the switchback route is temporarily removed by opening the outer cover.

Now, another aspect of this invention is described with reference to FIGS. 1, 19 and 20. Here in this section, an arrangement of the vicinity of an opening 66 of the switchback route 65 of the sheet transport device shown in FIG. 1 is described in detail referring to FIGS. 1, 19, and 20. FIG. 19 is a schematic diagram of the document image reader incorporated with the sheet transport device in a state that an outer cover 45 is opened to expose the interior of the document image reader (sheet transport device), and FIG. 20 is a perspective view of the vicinity of the opening 66 showing a state that an upper cover 653 constituting an upper wall of the switchback route 65 is temporarily removed by opening the outer cover 45.

As described above, the sheet transport device is provided with the switchback route 65 for temporarily holding a document (sheet) P from the first transport path 31 for a double-sided image reading of the document P. Temporarily guiding the document P into the switchback route 65 in an entering direction and feeding the document P in a direction opposite to the entering direction to the second transport path 32 accomplishes a switchback operation of the document P.

An end of the switchback route 65 is formed with the opening 66 opened toward an exterior of a main body of the sheet transport device. The lead end of the document P in the entering direction is temporarily discharged outside the device main body through the opening 66 as the document P proceeds along the switchback route 65. This arrangement reduces the size of the switchback route 65 of the sheet transport device and realizes a compact size of the document image reader.

Providing the opening 66 in the switchback route 65, however, may allow foreign matters such as clips and dusts to intrude into the switchback route 65 through the opening 66, which may obstruct a smooth transport of the document P along the switchback route 65. Further, intrusion of the foreign matters may result in an operation failure of the device.

In order to eliminate the above-mentioned problem, a step portion 651 including a plane having a lower level than a lower wall constituting the switchback route 65 is formed over its whole width of the switchback route 65 around the opening 66. The stepped portion 651 has a substantially vertical wall 651*a*, an upper step 651*a* integrally formed of the lower wall of the switchback route 65 and a lower step 651*b*. The upper step 651*a* and the lower step 651*b* each is a substantially horizontal plane with a slightly upward slope with respect to the entering direction in the switchback route 65, namely, a temporarily sheet discharge direction (rightward direction in FIG. 1).

A hood portion 652 bulging downward in such a manner as to cover the stepped portion 651 from above is formed at a distal end of an upper wall constituting the switchback route 65 over the whole width of the switchback route 65 around the opening 66. The hood portion 652 bulges downward in such a manner that a distal end thereof is lowered than the level L (see FIG. 1) of the upper step 651*a* of the stepped portion 651 and that the hood portion 652 in transverse section is shaped into a continuous curve so as to smoothly guide the lead end of the document P in the temporarily discharge direction onto the lower step 651*b*.

The upper cover 653 constituting the upper wall of the switchback route 65 is part of the outer cover 45 of the sheet transport device. The outer cover 45 is pivotally opened and closed about an axis of a pivot shaft 451 so as to allow easy removal of a sheet stuck in the switchback route 65. When the outer cover 45 is opened, as shown in FIG. 19, the switchback route 65 is accessible from outside.

In the sheet transport device having the above construction, the switchback route 65 is provided at an uppermost location of the document image reader high above the document tray (sheet setting section) 10 and the discharge tray (sheet discharge section) 80, with the opening 66 opened toward the exterior of the device main body. This arrangement enables to efficiently use the space above the document tray 10 and the discharge tray 80 as a space for temporarily holding the document during a switchback operation in the switchback route 65, thereby making it possible to produce the document image reader of a compact size.

The stepped portion 651 is formed in the vicinity of the opening 66 of the switchback route 65 and the hood portion 652 is formed in such a manner as to cover the stepped portion 651 from above. With this arrangement, if foreign matters such as clips and dusts are to intrude inside the switchback route 65 through the opening 66, they must sneak into the switchback route 65 through a narrowed space below the hood portion 652 and then climb over the stepped portion 651. It is evident from the construction of the stepped portion 651 that most part of the foreign matters will be blocked by the vertical wall 651*w* of the stepped portion 651. This arrangement, accordingly, enables to prevent problems such as operation failure of the device and sheet jam due to intrusion of foreign matters.

Also, even if an operator inadvertently attempts to place a set of documents for image reading onto the lower step 651*b* near the opening 66, the vertical wall 651*w* of the stepped portion 651 blocks a forcible thrust operation of the document set into the switchback route 65. This arrangement accordingly prevents an erroneous document setting by an operator.

The switchback route 65 is exposed outside when the upper cover 653 constituting the switchback route 65 is temporarily removed accompanied by opening of the outer cover 45. In this state, the switchback route 65 is easily accessible to remove foreign matters collected around the stepped portion 651.

Figure 21:
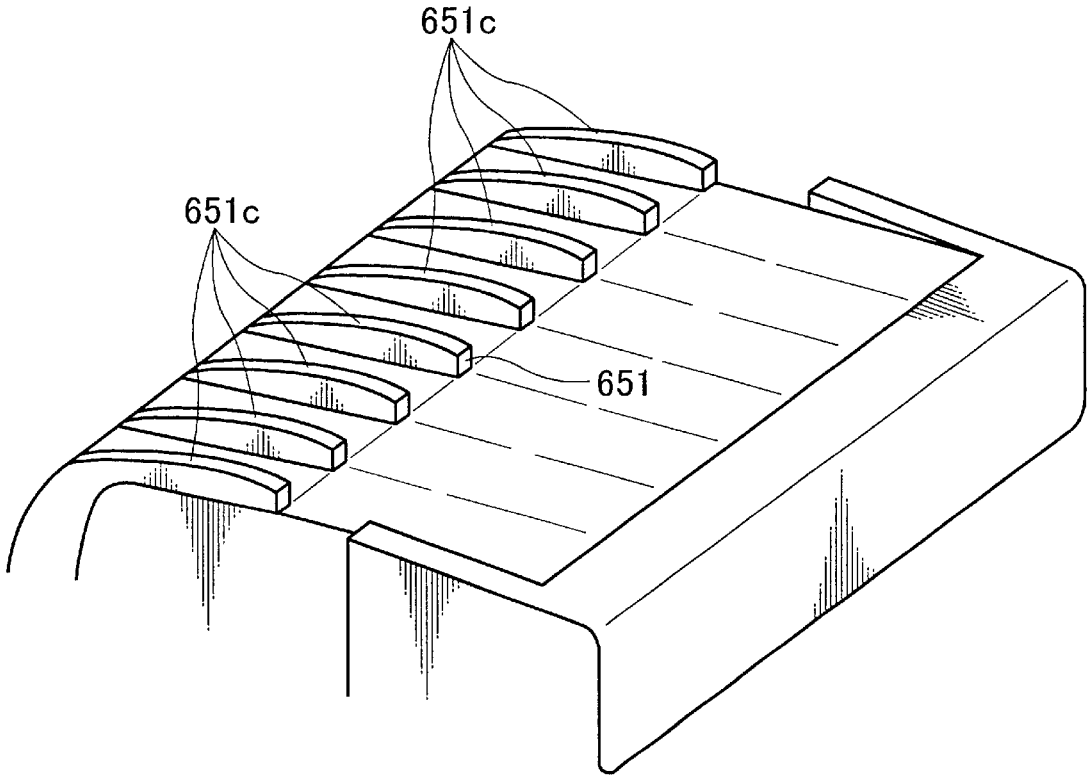
FIG. 21 is a perspective view of an altered form of the stepped portion formed with a series of rib members.

In this embodiment, the stepped portion 651 is formed substantially over the entire width of the switchback route 65. Alternatively, as shown in FIG. 21, the stepped portion 651 may be formed with a series of rib members 651*c* on the upper surface thereof in such a manner that the rib members 651*c* each project upwardly and are arrayed apart at a certain interval in the width direction of the switchback route 65. Each rib member 651*c* has a certain length in the sheet transport direction substantially orthogonal to the width direction of the switchback route 65.

The above altered arrangement is advantageous not only in preventing intrusion of foreign matters of a size beyond a certain dimension but also in giving the lead end of the document P in a sheet transport direction a transport backup force when the document P is being temporarily discharged through the opening 66, similar to the arrangement of the projecting tab 421 in the second junction 42. The altered arrangement effectively carries out a switchback operation of the document P.

Figure 22:
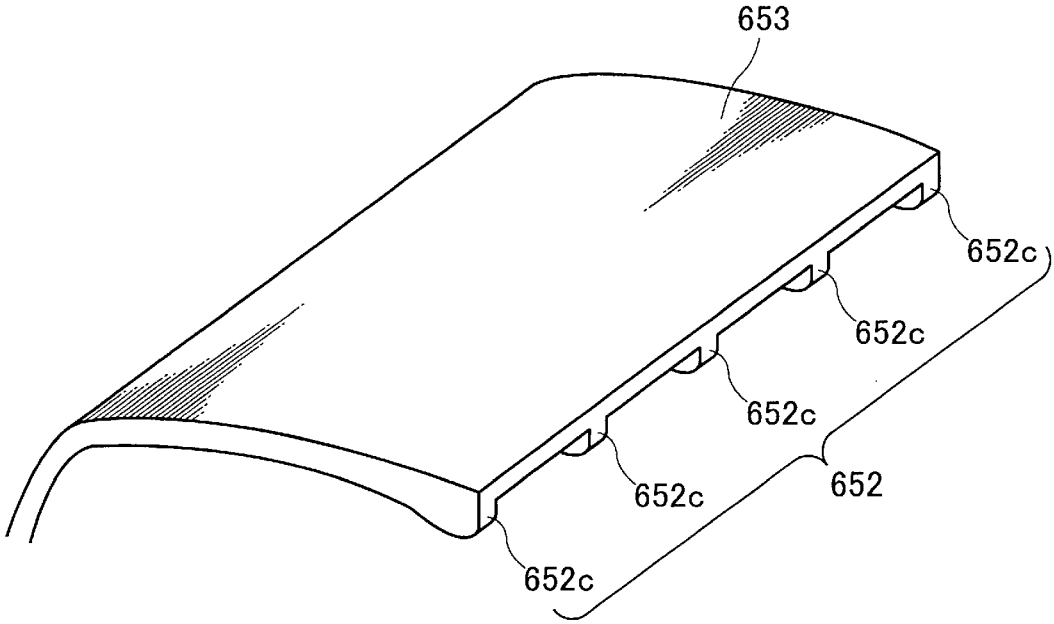
FIG. 22 is a perspective view of an altered form of a hood portion on the upper cover formed with a series of rib members projecting downward.

In this embodiment, the hood portion 652 is formed substantially over the whole width of the switchback route 65. As an altered form, the hood portion 652 may be partially formed, for example, at a substantially intermediate portion or opposite widthwise ends of the switchback route 65. Alternatively, as shown in FIG. 22, the hood portion 652 may be formed with a series of rib members 652*c* on the lower surface thereof in such a manner that the rib members 652*c* each project downward and are arrayed apart at a certain interval in the width direction of the switchback route 65. This altered arrangement also gives a sufficient transport backup force to the document P in the sheet transport direction as the document P is transported in and out of switchback route 65 through the opening 66.

In this embodiment, the stepped portion 651 has the substantially vertical wall. As an altered form, the wall may be inclined toward the side of the opening 66 (toward exterior of the device main body) or toward the inside of the switchback route 65. In this embodiment, the upper step 651*a* and the vertical wall 651*w* of the stepped portion 651 are jointed with a substantially right angle. The joint part may be shaped into a smooth curve. This altered arrangement is applicable to the joint part of the lower step 651*b* and the vertical wall 651*w* of he stepped portion 651.

In this embodiment, the hood portion 652 is integrally formed of the upper cover 653 near the distal end thereof. Alternatively, the distal end of the upper cover 653 may be directly bent downward to form a hood portion, or an additional member may be attached to the upper cover 653 to function as the hood portion.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet transport device for transporting a sheet along a transport path, comprising:

a projecting tab projecting inwardly in the transport path from an inner surface of the transport path with such a configuration as to guide the sheet in a specified transport direction, an opposite inner surface from the inner surface with the projecting tab presenting a continuous smooth surface, the projecting tab including a contact portion to be in contact with the sheet to form a wavy surface on the sheet in a width direction substantially orthogonal to the specified transport direction.

2. The sheet transport device according to claim 1, wherein the projecting tab is made of a single member, and the contact portion of the projecting tab is formed with one of a projection and a recess.

3. The sheet transport device according to claim 2, wherein the contact portion of the projecting tab is formed with one of a plurality of bulged portions and recessed portions.

4. The sheet transport device according to claim 1, wherein the projecting tab includes a plurality of projecting pieces arrayed in the width direction thereof.

5. The sheet transport deice according to claim 1, wherein the projecting tab is so configured that said contact portion is in symmetrical with respect to a center of the projecting tab in the width direction.

6. The sheet transport device according to claim 1, wherein the projecting tab is provided near an exit of the transport path for discharging the sheet onto a discharge tray.

7. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the contact portion of the projecting tab being formed in a continuous curve.

8. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the projecting tab being made of an elastic material.

9. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the projecting tab being provided in a junction at which the transport path is connected to a plurality of transport paths so as to guide the sheet transported in the junction to either one of the transport paths.

10. The sheet transport device according to claim 9, wherein the projecting tab is provided in the junction of the transport paths where a plurality of sheets are transported in an overlap state in opposite directions to each other.

11. The sheet transport device according to claim 10, wherein the contact portion of the projecting tab is so formed as to deflect widthwise opposite ends of the sheet being in contact with said contact portion away from the other sheet being transported in the overlap state.

12. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the projecting tab being provided on the transport path where the sheets are transported in an overlap state in opposite directions to each other.

13. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the projecting tab being provided on a curved portion of the transport path.

14. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, said transport path having a portion with a radius of curvature changing along the specified transport direction, the projecting tab being provided at a position in said portion of the transport path.

15. A sheet transport device for transporting a sheet along a transport path, comprising:

a projecting tab projecting inwardly in the transport path with such a configuration as to guide the sheet in a specified transport direction, the projecting tab including a contact portion to be in contact with the sheet to form a wavy surface on the sheet in a width direction substantially orthogonal to the specified transport direction, the projecting tab being provided on the transport path for transporting the sheet substantially upward.

16. A sheet transport device provided with a switchback route for temporarily allowing a sheet to enter therein to for a switchback operation, the switchback route being formed with an opening opened toward an exterior of the sheet transport device, wherein a stepped portion is provided near the opening, the stepped portion being formed with an upper step and a lower step which is formed adjacent to said upper step and on the side of said opening, said upper step constituting a lower wall of the switchback route and said lower step being of a lower level than said upper step.

17. The sheet transport device according to claim 16, wherein a hood portion is formed at a distal end of an upper wall, that is deflected further away from said stepped portion towards said opening, said hood portion constituting the switchback route together with said lower wall, said hood portion projecting downwardly beyond the height level of the upper step to cover the stepped portion from above.

18. The sheet transport device according to claim 16, wherein the switchback route is disposed above a sheet setting section and a sheet discharge section.

19. The sheet transport device according to claim 16, wherein the upper wall constituting the switchback route together with said lower wall is closably opened to render the switchback route accessible from the exterior of the sheet transport device.

* * * * *